US007759294B2

(12) United States Patent
Devlin et al.

(10) Patent No.: US 7,759,294 B2
(45) **Date of Patent: *Jul. 20, 2010**

(54) LUBRICANT COMPOSITIONS

(75) Inventors: Mark T. Devlin, Richmond, VA (US); Helen T. Ryan, London (GB)

(73) Assignee: Afton Chemical Corporation, Richmond, VA (US)

( * ) Notice: Subject to any disclaimer, the term of this patent is extended or adjusted under 35 U.S.C. 154(b) by 724 days.

This patent is subject to a terminal disclaimer.

(21) Appl. No.: 10/693,359

(22) Filed: Oct. 24, 2003

(65) Prior Publication Data

US 2005/0090410 A1 Apr. 28, 2005

(51) Int. Cl.

| | |
|---|---|
| ***C10M 135/04*** | (2006.01) |
| ***C10M 137/10*** | (2006.01) |
| ***C10M 159/12*** | (2006.01) |
| ***C10M 141/10*** | (2006.01) |
| ***C10M 173/02*** | (2006.01) |
| ***C10M 137/08*** | (2006.01) |
| ***C10M 137/04*** | (2006.01) |
| ***C10M 135/00*** | (2006.01) |
| ***C10M 135/22*** | (2006.01) |
| ***C10M 135/28*** | (2006.01) |
| ***C10L 1/22*** | (2006.01) |

(52) U.S. Cl. ..... 508/436; 508/322; 508/329; 508/421; 508/429; 508/431; 508/441; 508/558; 508/567; 508/569

(58) Field of Classification Search ..... 508/441, 508/558, 569, 322, 329, 421, 429, 432, 436, 508/567

See application file for complete search history.

(56) References Cited

U.S. PATENT DOCUMENTS

| | | | | |
|---|---|---|---|---|
| 2,599,350 | A | 6/1952 | Rudel et al. | |
| 3,002,014 | A | 9/1961 | Dinsmore et al. | |
| 3,853,775 | A | 12/1974 | Williams | |
| 4,107,168 | A | 8/1978 | Okorodudu | |
| 4,207,196 | A | 6/1980 | Sudekum | |
| 4,293,432 | A * | 10/1981 | Papay et al. | 508/438 |
| 4,303,539 | A | 12/1981 | Song | |
| 4,333,841 | A | 6/1982 | Schmidt et al. | |
| 4,431,552 | A | 2/1984 | Salentine | |
| 4,502,972 | A | 3/1985 | Davis et al. | |
| 4,584,113 | A | 4/1986 | Walsh | |
| 4,600,543 | A | 7/1986 | Bridger | |
| 4,710,100 | A * | 12/1987 | Laing et al. | 416/11 |
| 4,755,311 | A * | 7/1988 | Burjes et al. | 508/188 |
| 4,876,375 | A | 10/1989 | Lam | |
| 5,126,064 | A * | 6/1992 | Barber et al. | 508/287 |
| 5,171,466 | A | 12/1992 | Korosec | |
| 5,176,840 | A | 1/1993 | Campbell et al. | |
| 5,254,272 | A * | 10/1993 | Walters et al. | 508/294 |
| 5,282,988 | A | 2/1994 | Farng et al. | |
| 5,328,621 | A | 7/1994 | Camenzind et al. | |
| 5,342,531 | A | 8/1994 | Walters et al. | |
| 5,344,579 | A | 9/1994 | Ohtani et al. | |
| 5,354,484 | A | 10/1994 | Schwind et al. | |
| 5,358,650 | A | 10/1994 | Srinivasan et al. | |
| 5,441,656 | A | 8/1995 | Ohtani et al. | |
| 5,443,744 | A | 8/1995 | Bloch et al. | |
| 5,464,549 | A | 11/1995 | Sieberth | |
| 5,468,403 | A | 11/1995 | Romanelli et al. | |
| 5,492,638 | A | 2/1996 | Wallace et al. | |
| 5,531,911 | A | 7/1996 | Adams et al. | |
| 5,573,696 | A | 11/1996 | Hughes et al. | |
| 5,587,432 | A | 12/1996 | Scattergood | |
| 5,612,295 | A | 3/1997 | Bell et al. | |
| 5,691,283 | A | 11/1997 | Poat et al. | |
| 5,700,764 | A | 12/1997 | Walters et al. | |
| 5,763,372 | A | 6/1998 | Tersigni et al. | |
| 5,843,874 | A | 12/1998 | Macpherson et al. | |
| 5,942,470 | A | 8/1999 | Norman et al. | |
| 6,096,691 | A | 8/2000 | Conary et al. | |
| 6,184,186 | B1 | 2/2001 | Ryan et al. | |
| 6,221,274 | B1 | 4/2001 | Akahori et al. | |
| 6,380,139 | B1 | 4/2002 | Zinke et al. | |
| 6,482,777 | B2 | 11/2002 | Cain | |
| 6,531,429 | B2 | 3/2003 | Fletschinger et al. | |
| 6,573,223 | B1 | 6/2003 | Vinci | |
| 6,844,300 | B2 * | 1/2005 | Milner et al. | 508/322 |
| 2002/0119895 | A1 * | 8/2002 | Cook et al. | 508/186 |

FOREIGN PATENT DOCUMENTS

| | | | |
|---|---|---|---|
| EP | 391653 | A2 * | 10/1990 |
| EP | 0 620 286 | A | 10/1994 |
| EP | 1 439 216 | | 7/2004 |
| JP | 2-298590 | | 12/1990 |
| JP | 5-209186 | | 8/1993 |
| JP | 2001-311090 | | 11/2001 |

OTHER PUBLICATIONS

STN [online][retrieved on Mar. 21, 2007] Retrieved from the Internet: <URL: http://www.stn.cas.org/>.*

Pohlen, J., "Lubricants for Wind Power Plants," NLGI Spokesman, 2003, 8-16, 67(2).

* cited by examiner

*Primary Examiner*—Patrick D Niland
(74) *Attorney, Agent, or Firm*—MH2 Technology Law Group LLP

(57) ABSTRACT

Lubricant compositions having improved load carrying capacity comprising an extreme pressure compound comprising a sulfur-containing compound, a load carrying capacity enhancing combination comprising a hydrocarbylamine compound and an alkylphosphorothioate compound, a friction modifier compound, and a diluent or base oil as applicable. These lubricant compositions can be used as industrial oils well-suited for the demands of geared device applications, such as in wind turbine gear-boxes and automotive gears and axles.

14 Claims, No Drawings

LUBRICANT COMPOSITIONS

TECHNICAL FIELD

This invention generally relates to new and highly useful lubricant compositions, and, more particularly, this invention relates to new gear oil additive concentrates and gear oils containing them which have enhanced load carrying capacity.

BACKGROUND OF THE INVENTION

Industrial oils are often used in rigorous applications in which oils having improved load carrying capacity are in demand.

For instance, wind turbine applications, such as those used in wind farms or wind plants as an alternative renewable source of energy, are increasingly attracting more interest. Wind-electric turbine generators, also known as wind turbines, use the energy contained in the wind to spin a rotor (i.e., blades and hub). As the air flows past the rotor of a wind turbine, the rotor spins and drives the shaft of an electric generator to produce electricity. Wind turbine usage is increasing throughout the world, with about a three-fold increase in power generated from wind turbines occurring between 1998 and 2001 alone. Pohlen, J., "Lubricants for Wind Power Plants," NLGI Spokesman 67(2), 8-16, (2003). To create this energy using a conventional wind turbine, a gear-box is typically placed between the rotor of the wind turbine and the rotor of a generator. More specifically, the gear-box connects a low-speed shaft turned by the wind turbine rotor at about 30 to 60 rotations per minute to a high speed shaft that drives the generator to increase the rotational speed up to about 1200 to 1600 rpm, the rotational speed required by most generators to produce electricity. This geared solution can result in a torque through the system of close to 2 million N*m. Pohlen, J., "Lubricants for Wind Power Plants", NLGI Spokesman 67(2), 8-16, (2003). This high torque can put a large amount of stress on the gears and bearings in the geared wind turbine. Wind turbine oils are desired that will enhance the fatigue life of both the bearings and gears in the wind turbines.

Gearless direct drive wind turbines have been developed, which have the advantage of having less moving parts to maintain, but have their own drawbacks of generally being heavier and generally being open models allowing cold air to pass through, which may pose an increased risk of corrosion, especially in offshore installations. In any event, it is expected that both types of wind turbines will co-exist for some time. Therefore, wind turbine oils that would enhance the fatigue life of bearings and gears in gear-boxes used in geared wind turbines would increase the opportunities to use the geared solution in the most efficient, reliable and cost-effective manner.

More generally, inasmuch as gear oils are often subjected to prolonged periods of use between any maintenance and service intervals, such as in wind turbines, as well as in vehicular differentials and like devices, it generally is important to provide gear oil additive systems having good load carrying capacity to help provide improved service performance over lengthy durations of time. In addition, while acceptable performance of the lubricating oil is needed, it is also highly desirable that the additive or additives be cost-attractive and conveniently manufactured.

SUMMARY OF THE INVENTION

The present invention provides lubricant compositions having improved load carrying capacity.

In one of its embodiments, this invention provides a top treat additive concentrate which comprises:

a) an extreme pressure compound comprising a sulfur-containing compound;

b) load carrying capacity enhancing combination including (i) a hydrocarbylamine compound and (ii) an alkylphosphorothioate compound;

c) a friction modifying compound; and d) a diluent oil, wherein any of compounds a), b)(i), b)(ii), and c) can be the same or different compounds with the proviso that b)(i) and b)(ii) are different.

In another embodiment, there is a finished lubricant comprising a major amount of an oil of lubricating viscosity and a minor amount comprising the above components a), b), and c). For purposes herein, references to component "b)" generally means a combination including compounds b)(i) and b)(ii).

The combined presence of a hydrocarbylamine compound and an alkylphosphorothioate compound has been surprisingly found to synergistically act to improve the load carrying capacity of the lubricant composition. Each of these compounds previously have been used as antiwear additives, but their effect of enhancing the load carrying capacity of lubricant compositions, when used in combination therein according to embodiments of the present invention, is surprising and unexpected.

The lubricant compositions of embodiments described herein are useful as industrial and automotive gear oils, among other lubrication applications. The lubricant compositions of embodiments of the present invention may be advantageously used as lubricating gear oils having improved load carrying capacity. They are especially well-adapted for high load gear oil applications, such as encountered in gear boxes of wind turbines, vehicular differentials, and like devices. For instance, they can be used to lubricate mechanical parts in gear-boxes of wind turbine gear assemblies. The lubricant compositions also can be used in automotive, heavy-duty truck and bus manual transmissions, and rear axles.

For purposes herein, the terminology "lubricant compositions" refers collectively to additive concentrates and finished lubricants. The term "load carrying capacity" refers to the load capacity of a lubricant as measured according to ASTM D-2782.

DETAILED DESCRIPTION OF THE PREFERRED EMBODIMENTS

The present invention generally relates to lubricant compositions containing a load carrying capacity enhancing additive component comprising a combination of a hydrocarbylamine compound and an alkylphosphorothioate compound. Experimental studies, which are described herein, show that the combined presence of a hydrocarbylamine compound and an alkylphosphorothioate compound in the lubrication compositions synergistically acts to improve the load carrying capacities of such compositions. The lubricant compositions that may be enhanced in this manner include additive concentrates and finished lubricants.

It will be appreciated that lubricant compositions of this invention have wide application encompassing industrial and automotive gear oil applications. The lubricants are especially well-suited for gear oil applications in which improved load carrying capacity are demanded or highly desirable, such as in wind turbine gear boxes and vehicular differential applications. In one non-limiting embodiment of the present invention, the gear oil is used to lubricate gear parts in gear-boxes of wind turbine devices and the like. Wear and surface fatigue in gears and bearings, such as those used in wind turbines, is reduced by lubrication with the inventive lubricant compositions such that service lives of gear parts are improved and maintenance requirements are lessened.

Sulfur-Containing Extreme Pressure Agents (Compound a))

The lubricant compositions of the present invention contain at least one sulfur-containing extreme pressure (EP) agent. A wide variety of sulfur-containing extreme pressure are available for use in the practice of this invention. Among suitable compositions for this use are included sulfurized animal or vegetable fats or oils, sulfurized animal or vegetable fatty acid esters, fully or partially esterified esters of trivalent or pentavalent acids of phosphorus, sulfurized olefins (see for example U.S. Pat. Nos. 2,995,569; 3,673,090; 3,703,504; 3,703,505; 3,796,661; 3,873,545; 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), sulfurized Diels-Alder adducts (see for example U.S. Pat. Nos. 3,632,566; 3,498,915; and Re 27,331), sulfurized dicyclopentadiene (see for example U.S. Pat. Nos. 3,882,031 and 4,188,297), sulfurized or co-sulfurized mixtures of fatty acid esters and monounsaturated olefin (see for example U.S. Pat. Nos. 4,149,982; 4,166,796; 4,166,797; 4,321,153; 4,481,140), co-sulfurized blends of fatty acid, fatty acid ester and α-olefin (see for example U.S. Pat. No. 3,953,347), functionally-substituted dihydrocarbyl polysulfides (see for example U.S. Pat. No. 4,218,332), thia-aldehydes, thia-ketones and derivatives thereof (e.g., acids, esters, imines, or lactones) (see for example, U.S. Pat. No. 4,800,031; and PCT International Application Publication No. WO 88/03552), epithio compounds (see for example, U.S. Pat. No. 4,217,233), sulfur-containing acetal derivatives (see for example U.S. Pat. No. 4,248,723), co-sulfurized blends of terpene and acyclic olefins (see for example U.S. Pat. No. 4,584,113), sulfurized borate compounds (see for example U.S. Pat. No. 4,701,274), and polysulfide olefin products (see for example U.S. Pat. No. 4,795,576). The disclosures of the foregoing patents are incorporated herein by reference.

Preferred materials useful as the sulfur-containing extreme pressure component are sulfur-containing organic compounds in which the sulfur-containing species are bound directly to carbon or to more sulfur.

One particularly preferred class of such agents is made by reacting an olefin, such as isobutene, with sulfur. The product, e.g., sulfurized isobutene, preferably sulfurized polyisobutylene, typically has a sulfur content of 10 to 55%, preferably 30 to 50% by weight. A wide variety of other olefins or unsaturated hydrocarbons, e.g., isobutene dimer or trimer, may be used to form such agents.

Another particularly preferred class of such agents is that of polysulfides composed of one or more compounds represented by the formula: $R_a—S_x—R_b$ where $R_a$ and $R_b$ are hydrocarbyl groups each of which preferably contains 3 to 18 carbon atoms and x is preferably in the range of from 2 to 8, and more preferably in the range of from 2 to 5, especially 3. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) are preferred. Examples of other useful dihydrocarbyl polysulfides include the diamyl polysulfides, the dinonyl polysulfides, the didodecyl polysulfides, and the dibenzyl polysulfides, among others.

In one embodiment, the sulfur-containing extreme pressure agents contain at least 25 percent by weight sulfur. In one embodiment, the amount of said EP agent added to the finished gear oil will be sufficient to provide at least 1,000 ppm sulfur, more preferably 1,000 to 20,000 ppm sulfur and most preferably 2,000 to 12,000 ppm sulfur in the finished gear oil.

As used herein, the terminology "hydrocarbyl substituent" or "hydrocarbyl group" is generally used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Load Carrying Capacity Enhancing Combination (Combination b))

The combination of an alkylphosphorothioate and a hydrocarbylamine as used as surface active agents in sulfur-containing oil compositions in accordance with embodiments of this invention has the observed effect of increasing the load carrying capacity of lubricant compositions when used in an effective amount. For example, lubricant compositions that otherwise are the same but that lack this combination of alkylphosphorothioate and hydrocarbylamine have decreased (lower) load carrying capacities. The alkylphosphorothioate and hydrocarbylamine can be added separately or as a pre-mixture to lubricant compositions. Thus, the characterization herein of using the alkylphosphorothioate and hydrocarbylamine in "combination" refers to their co-presence in a completed formulation of the additive concentrate and/or finished lubricant. The alkylphosphorothioates and hydrocarbylamines are two classes of compounds that comprise different chemical compounds for purposes of this invention.

In one non-limiting example, a commercially available source of such a mixture of alkylphosphorothioates and hydrocarbylamines is HiTEC®-833, manufactured by Ethyl Corporation.

1) Alkylphosphorothioate Compound (Compound b)(i))

The alkylphosphorothioates used in this invention may be generally represented by the formula:

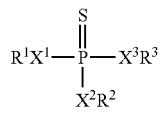

where each of $R^1$, $R^2$, and $R^3$ is, independently, a substituted or nonsubstituted alkyl group or a hydrogen atom, and where at least one of $R^1$, $R^2$, and $R^3$ is a substituted or nonsubstituted alkyl group, and where each of $X^1$, $X^2$, and $X^3$ is, independently, an oxygen atom or a sulfur atom. In one embodiment, $R^1$, $R^2$, and $R^3$ independently represent unsubstituted or substituted alkyl groups having 3 to 20 carbon atoms. For purpose herein, the term "alkyl" refers generally to either aliphatic alkyl or cycloalkyl groups. The aliphatic alkyl groups can be unbranched or branched. In one non-limiting embodiment, at least one of $R^1$, $R^2$, and $R^3$ is an unsubstituted aliphatic alkyl group of 3 to 20 carbon atoms.

In one preferred embodiment, the alkylphosphorothioate is an alkylphosphoro(mono)thioate, where each of $X^1$, $X^2$, and $X^3$ of the above structural formula represents an oxygen atom. Suitable alkylphosphoro(mono)thioates include, for example, the alkylphosphorothioates compounds described in U.S. Pat. Nos. 4,431,552, 5,531,911, and 6,531,429 B2, which descriptions are incorporated herein by reference.

In another embodiment, alkylphosphorodithioates, where two among $X^1$, $X^2$, and $X^3$ of the above structural formula each represent an oxygen atom and the remaining moiety represents a sulfur atom, and alkylphosphorotrithioates, where $X^1$, $X^2$, and $X^3$ each represents a sulfur atom, also are covered by the above structural formula. Suitable alkylphosphorodithioates include, for example, the compounds described in U.S. Pat. Nos. 4,333,841, 5,544,492, and 6,531,429 B2 which descriptions are incorporated herein by reference.

Methods for making the alkyl phosphorothioates include generally known methods for that purpose.

2) Hydrocarbylamine Compound (Compound b)(ii))

In one embodiment, the hydrocarbylamine compound suitable for use in the load carrying capacity enhancing combination is an alkyleneamine compound. A non-limiting class of such compounds includes N-aliphatic hydrocarbyl-substituted trimethylenediamines in which the N-aliphatic hydrocarbyl-substituent is at least one straight chain aliphatic hydrocarbyl group free of acetylenic unsaturation and having in the range of about 14 to about 20 carbon atoms. A non-limiting example of such alkyleneamine compounds for the load carrying capacity enhancing combination is N-oleyl-trimethylene diamine. This compound is commercially available under the trade designation Duomeen®-O from Akzo Chemical Company. Other suitable compounds include N-tallow-trimethylene diamine (Duomeen®-T) and N-coco-trimethylene diamine (Duomeen®-C).

In another embodiment, the hydrocarbylamines suitable for use in the load carrying capacity enhancing combination comprise primary alkylamines having the general formula: $R'NH_2$, wherein R' is an alkyl group containing up to about 150 carbon atoms and will more often be an aliphatic alkyl group containing from about 4 to about 30 carbon atoms. In one particular embodiment, the hydrocarbylamines are primary alkylamines containing from about 4 to about 30 carbon atoms in the alkyl group, and more preferably from about 8 to about 20 carbon atoms in the alkyl group. The alkyl group can be unsubstituted or substituted, such by susbtituents described above in connection with the hydrocarbyl group, and reference is made thereto.

Representative examples of primary alkylamines include aliphatic primary fatty amines, including those commercially known as "Armeen®" primary amines (products available from Akzo Nobel Chemicals, Chicago, Ill.). Typical fatty amines include alkylamines such as n-hexylamine, n-octylamine, n-decylamine, n-dodecylamine, n-tetradecylamine, n-pentadecylamine, n-hexadecylamine, n-octadecylamine (stearyl amine), and the like. These Armeen primary amines are available in both distilled and technical grades. While the distilled grade will provide a purer reaction product, the desirable amides and imides will form in reactions with the amines of technical grade. Also suitable are mixed fatty amines such as Akzo's Armeen-C, Armeen-O, Armeen-OL, Armeen-T, Armeen-HT, Armeen-S and Armeen-SD.

In another embodiment, the hydrocarbylamines of the composition of this invention are tertiary-aliphatic primary amines having at least about 4 carbon atoms in the alkyl group, and more particularly from 4 to 30 carbon atoms. Usually the tertiary aliphatic primary amines are monoamines represented by the formula

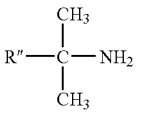

wherein R" is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of hydrocarbylamines are also useful for the purposes of this invention. Illustrative of alkylamine mixtures of this type are "Primene 81R" which is a mixture of $C_{11}$-$C_{14}$ tertiary alkyl primary amines and "Primene JM-T" which is a similar mixture of $C_{18}$-$C_{22}$ tertiary alkyl primary amines (both are available from Rohm and Haas Company). The tertiary alkyl primary amines and methods for their preparation are well known to those of ordinary skill in the art and, therefore, further discussion is unnecessary. The tertiary alkyl primary amine useful for the purposes of this invention and methods for their preparation are described in U.S. Pat. No. 2,945,749 which is hereby incorporated by reference for its teaching in this regard.

Useful secondary alkylamines include dialkylamines having two of the above alkyl groups including such commercial fatty secondary amines as Armeen-2C and Armeen-2HT, and also mixed dialkylamines where R' is a fatty amine and R" may be a lower alkyl group (1-9 carbon atoms) such as methyl, ethyl, n-propyl, i-propyl, butyl, etc., or R" may be an alkyl group bearing other non-reactive or polar substituents (CN, alkyl, carbalkoxy, amide, ether, thioether, halo, sulfoxide, sulfone) such that the essentially hydrocarbon character of the radical is not destroyed. The fatty polyamine diamines include mono-or dialkyl, symmetrical or asymmetrical ethylene diamines, propane diamines (1,2, or 1,3), and polyamine analogs of the above. Suitable commercial fatty polyamines are available under the Duomeen® tradename from Akzo Nobel. Suitable polyamines include Duomeen C(N-coco-1,3-diaminopropane), Duomeen S(N-soyaalkyl trimethylenediamine), Duomeen T (N-tallow-1,3-diaminopropane), or Duomeen OL (N-oleyl-1,3-diaminopropane).

Friction Modifying Compound (Compound (c))

The friction modifying compound can be selected from among many suitable compounds and materials useful for imparting this function in lubricant compositions, which are compatible with the load carrying capacity enhancing combination used in compositions of the present invention. Non-limiting examples of the friction modifier include long chain alkylene amines, long chain alkyl phosphonates, and dithiocarbamates.

Long chain alkylene amine friction modifying compounds include, for example, N-aliphatic hydrocarbyl-substituted trimethylenediamines in which the N-aliphatic hydrocarbyl-substituent is at least one straight chain aliphatic hydrocarbyl group free of acetylenic unsaturation and having in the range of about 14 to about 20 carbon atoms. The friction modifier compound can be used as a single type of compound or a mixture of different types of such compounds. The primary difference among the friction modifier compounds is the makeup of the particular hydrocarbyl substituent falling within the group as described above. A non-limiting example of such friction modifier compounds is N-oleyl-trimethylene diamine. This product is available on the market under the trade designation Duomeen-O from Akzo Chemical Company. Other suitable compounds include N-tallow-trimethylene diamine (Duomeen-T) and N-coco-trimethylene diamine (Duomeen-C).

Long chain alkyl phosphonate friction modifying compounds include, for example, the compounds described in U.S. Pat. Nos. 4,293,432 and 4,855,074, which descriptions are incorporated herein by reference. In one embodment, the alkyl phosphonates used in this invention may be generally represented by the formula:

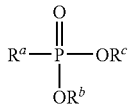

where each of $R^a$ is an alkyl group containing about 12-36 carbon atoms and $R^b$ and $R^c$ are independently selected from lower alkyl groups such as alkyl groups containing 1-4 carbon atoms. A non-limiting example of a source of suitable friction modifying long chain alkyl phosphonate is HiTEC®-059, available from Ethyl Corporation.

The diothiocarbamates friction modifying compounds include, for example, the compounds described in U.S. Pat. No. 3,853,775, which also can impart extreme pressure properties, which descriptions are incorporated herein by reference. The diothiocarbamate compounds used also can comprise alkali metal diothiocarbamates, such as those described in U.S. Pat. No. 2,599,350, which descriptions are incorporated herein by reference. The diothiocarbamate compounds used also can be compounds having dithiocarbamyl groups and moieties, such as those described in U.S. Pat. Nos. 4,207,196, 4,303,539, 4,502,972, and 4,876,375, which descriptions are incorporated herein by reference. A non-limiting example of a source of a suitable dithiocarbamate is Molyvan®-822 from R.T. Vanderbilt Company, Inc.

Multifunctional Compounds

In embodiments of the present invention, the above-described compounds a), b)(i), b)(ii), and c) can be the same or different compounds with the proviso that the load carrying capacity enhancing combination components b)(i) and b)(ii) are different.

In addition to those already identified above, other multifunctional compounds in this respect include, for example, thermally stable sulfur and phosphorus-containing compounds. These include reaction products of dicyclopentadiene and thiophosphoric acids, also referred to herein as dicyclopentadiene dithioates, which may be used as the extreme-pressure and/or friction modifying agents. Thiophosphoric acids which are generally useful in this respect have the formula:

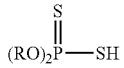

wherein R is a hydrocarbyl group having from 2 to 30, preferably 3 to 18 carbon atoms. In a preferred embodiment, R comprises a mixture of hydrocarbyl groups containing from 3 to 18 carbon atoms. Dithiothiadiazole is a non-limiting example of this type of phosphorous antiwear compound.

The dicyclopentadiene dithioates may be prepared by mixing dicyclopentadiene and a dithiophosphoric acid for a time and temperature sufficient to react the thioacid with the dicyclopentadiene. Typical reaction times range from 30 minutes to 6 hours, although suitable reaction conditions can readily be determined by one skilled in the art. The reaction product may be subjected to conventional post-reaction work up including vacuum stripping and filtering.

Other suitable multi-functional sulfur and phosphorus containing compounds which may be useful as one or both of compounds a) and c), for example, include phosphorus substituted dimercapto thiadiazoles, such as those described in U.S. Pat. No. 4,107,168, which descriptions are incorporated herein by reference. Still other suitable multi-functional sulfur and phosphorus containing compounds include sulfur-containing phosphate ester reaction products, such as those described in U.S. Pat. No. 5,443,744, which descriptions are incorporated herein by reference. Additional suitable multi-functional sulfur and phosphorus containing compounds include reaction products of at least one nitrogen-containing compound, at least one phosphorus-containing compound, and at least one mono- or di-sulfide-containing alkanol, such as those compounds as described in U.S. Pat. No. 5,443,744, which descriptions are incorporated herein by reference. Further suitable multi-functional sulfur and phosphorus containing compounds include those produced by reacting O,O-dihydrocarbyl phosporodithioic acid with a monoepoxide or mixture thereof having 20-30 carbon atoms or vegetable oil epoxide, followed by reacting that product with phosphorus pentoxide to produce an acid phosphate intermediate, which is neutralized with at least one amine, such as described in U.S. Pat. No. 5,573,696, which descriptions are incorporated herein by reference.

Diluent Oil (Compound d))

The additive concentrates of this invention preferably contain a suitable diluent. The diluent typically is present in the concentrates in a minor amount. In a preferred embodiment, it is an oleaginous diluent of suitable viscosity. Such a diluent can be derived from natural or synthetic sources, or blends thereof. Use of mineral oils as the diluent of the top treat additive concentrate is preferred. Among the mineral (hydrocarbonaceous) oils are paraffin base, naphthenic base, asphaltic base, and mixed base oils. Synthetic oils include polyolefin oils (especially hydrogenated α-olefin oligomers), alkylated aromatics, polyalkylene oxides, aromatic ethers, and carboxylate esters (especially diesters), among others. The diluents can be light hydrocarbon base oils, both natural and (per a) synthetic.

Generally, the diluent oil generally will have a viscosity in the range of about 1 to about 40 cST at 100EC, and preferably about 2 to about 15 cST at 100EC. In one particular embodiment, the diluent oil is a 100 Neutral mineral oil having a viscosity of about 6 cSt at 100EC.

Base (Stock) Oil

The base oils, also referred to as base stocks, used in forming the gear oils of this invention can be any suitable natural or synthetic oil, or blend thereof, provided the lubricant has a suitable viscosity for use in gear applications. Natural sources of base oils include hydrocarbon oils of lubricating viscosity derived from petroleum, tar sands, coal, shale, and so forth, as well as natural oils such as rapeseed oil, and the like. Synthetic base stocks include, for example, poly-α-olefin oils (PAO, such as hydrogenated or unhydrogenated α-olefin oligomers), hydrogenated polyolefins, alkylated aromatics, polybutenes, alkyl esters of dicarboxylic esters, complex esters of dicarboxylic esters, polyol esters, polyglycols, polyphenyl ethers, alkyl esters of carbonic or phosphoric acids, polysilicones, fluorohydrocarbon oils, and mixtures thereof. The poly-α-olefins, for instance, typically have viscosities in the range of 2 to 100 cSt at 100EC, preferably 4 to 8 cSt at 100EC. They may, for example, be oligomers of branched or straight chain α-olefins having from 2 to 16 carbon atoms, specific examples being polypropenes, polyisobutenes, poly-1-butenes, poly-1-hexenes, poly-1-octenes and poly-1-decene. Included are homopolymers, interpolymers and mixtures.

In one embodiment, mineral oil base stocks are used such as for example conventional and solvent-refined paraffinic neutrals and bright stocks, hydrotreated paraffinic neutrals and bright stocks, naphthenic oils, cylinder oils, and so forth, including straight run and blended oils. In one more particular embodiment, synthetic base stocks can be used such as, for example, blends of poly-α-olefins with synthetic diesters in weight proportions (PAO:ester) ranging from about 95:5 to about 50:50.

The base oils will normally, but not necessarily always, have a viscosity range of SAE 50 to about SAE 250, and more usually about SAE 70 to about SAE 140.

Base stock oils suitable for use in the present invention may be made using a variety of different processes including but not limited to distillation, solvent refining, hydrogen processing, oligomerisation, esterification, and re-refining. For instance, poly-α-olefins (PAO) include hydrogenated oligomers of an α-olefin, the most important methods of oligomerisation being free radical processes, Ziegler catalysis, and cationic, Friedel-Crafts catalysis.

Certain of these types of base oils may be used for the specific properties they possess such as biodegradability, high temperature stability, or non-flammability. In other compositions, other types of base oils may be preferred for reasons of availability or lower cost. Thus, the skilled artisan will recognize that while various types of base oils discussed above may be used in the lubricant compositions of this invention, they are not necessarily equivalents of each other in every application.

Additive Concentrate Formulation

The additive concentrates of embodiments of this invention generally contain a minor amount of diluent and the remainder is comprised of the primary additives described herein, i.e., the extreme pressure S-containing compound, the load carrying enhancer components including the alkylphosphorothioate compound and the hydrocarbylamine compound, and the friction modifier compound. In general, additive concentrates include the following concentrations (weight percent) of the primary additives as indicated in Table I below.

TABLE I

| | General Range | Preferred Range |
|---|---|---|
| extreme pressure S-containing compound | 20-60 | 30-50 |
| alkylphosphorothioate compound | 10-30 | 15-25 |
| hydrocarbylamine compound | 10-30 | 15-25 |
| friction modifier compound | 10-30 | 15-25 |

For gear oil applications, the lubricants are generally formulated with the base oil and the other additives described herein to have a kinematic viscosity of at least 12 cSt at 100° C.

In one preferred embodiment, the formulated additive concentrate is a homogenous, oil-soluble composition. As used herein, "oil-soluble" means the material under discussion can be dissolved in or be stably dispersed in a base oil to at least the minimum concentration needed for use as described herein. Preferably, the material has a solubility or dispersibility in the base oil well in excess of such minimum concentrations. However, the term does not mean that the material must dissolve or be dispersible in all proportions in the base oil.

Finished Lubricant Formulation

Typically, in gear oil applications, the lubricant compositions will contain an oil of lubricating viscosity in a major amount and the active compounds and combinations a), b) and c) of the additive concentrate constitute a minor amount thereof. In one embodiment, the finished lubricant will comprise from about 90 to about 99 percent by weight of base oil, and the oil-soluble additive concentrate will comprise about 10 to about 1 percent by weight, of the finished lubricant. In a specific, non-limiting embodiment, the oil-soluble additive concentrate is contained in an amount of about 2 to about 8 percent by weight, while the base oil comprises the remainder of the finished lubricant.

In general, finished lubricants include the following concentrations (weight percent) of the primary additives in a base oil stock as indicated in Table II below.

TABLE II

| | General Range | Preferred Range |
|---|---|---|
| extreme pressure S-containing compound | 0.5-2.5 | 0.7-1.7 |
| alkylphosphorothioate compound | 0.1-1.0 | 0.2-0.8 |
| hydrocarbylamine compound | 0.1-1.0 | 0.2-0.8 |
| friction modifier compound | 0.1-1.0 | 0.2-0.8 |

For gear oil applications, the lubricants are generally formulated with the base oil and the other additives described herein to have a kinematic viscosity of at least 12 cSt at 100EC.

The lubricant compositions of the present invention may be top treated with the additive concentrates to achieve multifunctional performance (i.e., both industrial and automotive applications).

For purposes herein, "an extreme pressure compound" generally means a lubricating substance that withstands heavy loads imposed on gear teeth; a "load carrying capacity enhancer" generally means a substance that increases the load carrying capacity of a substance as compared to the same substance devoid of the enhancer; a "friction modifier" or "friction modifying" material generally means a substance which enhances the ability of oil to remain slippery. These additives are used in amounts in oils effective to impart at least these respective functions. However, it will be appreciated that although the various additives described herein are described occasionally with reference to such associated respective functions, such as those defined above, that function may be one of other functions served or imparted by the same component and the definitions above should not be construed as a mandatory single limiting function of the respective additive. For instance, the characterization herein of the "load carrying enhancer" components as such, is exemplary and not limiting as to the functional properties imparted by these compounds, and the synergism achieved by the co-presence of these compounds in the lubricating composition is independent of and supplemental to these characterizations.

Other Additives

The finished lubricants and additive concentrates of this invention can contain various other conventional additives in a minor amount to partake of their attendant functions. These include, for example, dispersants, antiwear agents, defoamers, demulsifiers, antioxidants, copper corrosion inhibitors, rust inhibitors, pour point depressants, detergents, dyes, metal deactivators, supplemental friction modifiers, and diluents, and so forth. However, the supplemental additives must not interfere with the load carrying enhancement otherwise imparted by the combined presence of the hydrocarbylamine compound and the phosphorothioate compound.

A dispersant may be included to help scatter the dispersed phase in the dispersion medium. For instance, dispersants useful in this invention include basic nitrogen-containing dispersants such as hydrocarbyl succinimides; hydrocarbyl succinamides; mixed ester/amides of hydrocarbyl-substituted succinic acids formed by reacting a hydrocarbyl-substituted succinic acylating agent stepwise or with a mixture of alcohols and amines, and/or amino alcohols; Mannich condensation products of hydrocarbyl-substituted phenols, formaldehydes and polyamines; amine dispersants such as formed by reacting high molecular weight aliphatic or alicyclic halides with amines, such as polyalkylene polyamines, and also hydroxy-substituted polyamines, and polyoxyalkylene polyamines. These dispersants can be used singly or as mixtures thereof. Suitable examples of these dispersant compounds include those described and referenced in U.S. Pat. No. 5,612,295, which descriptions are incorporated herein by reference.

In one embodiment, the dispersant containing basic nitrogen may be a hydrocarbyl succinimide, a hydrocarbyl succinic ester-amide or a Mannich base of polyamine, formaldehyde and a hydrocarbyl phenol in which the hydrocarbyl substituent is a hydrogenated or unhydrogenated polyolefin group and preferably a polypropylene or isobutene group having a number average molecular weight (as measured by gel permeation chromatography) of from 250 to 10,000, and more preferably from 500 to 5,000, and most preferably from 750 to 2,500. In one non-limiting embodiment, the dispersant compound containing basic nitrogen is a polyolefin amide alkylamine.

In one non-limiting preferred embodiment, the dispersant containing basic nitrogen comprises an alkenyl succinimide. A suitable commercially available source of a dispersant compound containing a basic nitrogen for use as compound d) in this invention includes, for example, a polybutenyl succinimide ashless dispersant, which is commercially available as HiTEC®-633 from Ethyl Corporation. Other suitable alkenyl succinimides include those described and identified in U.S. Pat. No. 5,612,295, which descriptions are incorporated herein by reference.

The lubricant compositions of the present invention also may contain an anti-wear agent. In one embodiment, the anti-wear agent comprises a thermally stable phosphorus-containing anti-wear agent. A phosphorous-containing anti-wear compound, if used, generally will be contained in the finished lubricant in an amount sufficient to provide about 100 to about 500 ppm phosphorus therein.

Suitable phosphorus-containing anti-wear agents include oil-soluble amine salts or amine adducts of a phosphoric acid ester, such as those taught in U.S. Pat. Nos. 5,354,484, 5,763,372, and 5,942,470, which descriptions are incorporated herein by reference. The phosphorus-containing anti-wear agents also may be the reaction product of dicyclopentadiene and a thiophosphoric acid, including those such as described above.

Defoamers suitable for use in the present invention include silicone oils of suitable viscosity, glycerol monostearate, polyglycol palmitate, trialkyl monothiophosphates, esters of sulfonated ricinoleic acid, benzoylacetone, methyl salicylate, glycerol monooleate, glycerol dioleate and polyacrylates. Defoamers are generally employed at concentrations of up to about 1% in the additive concentrate.

Demulsifiers that may be used include alkyl benzene sulfonates, polyethylene oxides, polypropylene oxides, esters of oil soluble acids and the like. Such additives are generally employed at concentrations of up to about 3% in the additive concentrate.

Copper corrosion inhibitors include as thiazoles, triazoles and thiadiazoles. Examples include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis-(hydrocarbyldithio)-1,3,4-thiadiazoles. The preferred compounds are the 1,3,4-thiadiazoles, especially the 2-hydrocarbyldithio-5-mercapto-1,3,4-dithiadiazoles and the 2,5-bis(hydrocarbyidithio)-1,3,4-thiadiazoles, a number of which are available as articles of commerce. Other suitable inhibitors of copper corrosion include ether amines; polyethoxylated compounds such as ethoxylated amines, ethoxylated phenols, and ethoxylated alcohols; imidazolines; and the like. See, for example, U.S. Pat. Nos. 3,663,561 and 4,097,387. Concentrations of up to about 3% in the concentrate are typical. Preferred copper corrosion inhibitors include ashless dialkyl thiadiazoles. One example of a commercially available ashless dialkyl thiadiazole is HiTEC® 4313 corrosion inhibitor, available from Ethyl Corporation.

Dialkyl thiadiazoles suitable for the practice of the instant invention are of the general formula:

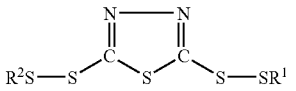

wherein $R^1$ is a hydrocarbyl substituent having from 6 to 18 carbon atoms; $R^2$ is a hydrocarbyl substituent having from 6 to 18 carbon atoms; and may be the same as or different from $R^1$. Preferably, $R^1$ and $R^2$ are about 9-12 carbon atoms, and most preferably $R^1$ and $R^2$ are each 9 carbon atoms.

Mixtures of dialkyl thiadiazoles of formula (I) with monoalkyl thiadiazoles may also be used within the scope of the present invention. Such mono alkyl thiadiazoles occur when either substituent $R^1$ or $R^2$ is H.

Antioxidants that may be employed in gear oil formulations include phenolic compounds, amines, phosphites, and the like. Amounts of up to about 5% in the concentrate are generally sufficient. The compositions of the present invention may include one or more anti-oxidants, for example, one or more phenolic antioxidants, hindered phenolic antioxidants, additional sulfurized olefins, aromatic amine antioxidants, secondary aromatic amine antioxidants, sulfurized phenolic antioxidants, oil-soluble copper compounds and mixtures thereof.

Suitable exemplary compounds include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, 4,4'-thiobis(2-methyl-6-tert-butylphenol), N,N'-di-sec-butyl-p-phenylenediamine, 4-isopropylaminodiphenyl amine, alkylated diphenylamine and phenyl-α-naphthyl amine.

In the class of amine antioxidants, oil-soluble aromatic secondary amines; aromatic secondary monoamines; and others are suitable. Suitable aromatic secondary monoamines include diphenylamine, alkyl diphenylamines containing 1 to 2 alkyl substituents each having up to about 16 carbon atoms, phenyl-α-naphthylamine, alkyl- or aralkyl substituted phenyl-α-naphthylamine containing one or two alkyl or aralkyl groups each having up to about 16 carbon atoms, alkyl- or aralkyl-substituted phenyl-α-naphthylamine containing one or two alkyl or aralkyl groups each having up to about 16 carbon atoms, alkylated p-phenylene diamines available from Goodyear under the tradename "Wingstay 100" and from Uniroyal, and similar compounds.

In the class of phenolic antioxidants, suitable compounds include ortho-alkylated phenolic compounds, e.g. 2-tert-butylphenol, 2,6-di-tertbutylphenol, 4-methyl-2,6-di-tertbutylphenol, 2,4,6-tri-tertbutylphenol, and various analogs and homologs or mixtures thereof; one or more partially sulfurized phenolic compounds as described in U.S. Pat. No. 6,096,695, the disclosure of which is incorporated herein by reference; methylene-bridged alkylphenols as described in U.S. Pat. No. 3,211,652, the disclosure of which is incorporated herein by reference.

Antioxidants may be optionally included in the fully formulated final inventive lubricating composition at from about 0.00 to about 5.00 weight percent, more preferably from about 0.01 weight % to about 1.00 weight %.

Rust inhibitors may be used in the practice of the present invention. This may be a single compound or a mixture of compounds having the property of inhibiting corrosion of ferrous metal surfaces. Such materials include oil-soluble monocarboxylic acids such as 2-ethylhexanoic acid, lauric acid, myristic acid, palmitic acid, oleic acid, linoleic acid, linolenic acid, behenic acid, cerotic acid, etc., and oil-soluble polycarboxylic acids including dimer and trimer acids, such as are produced from tall oil fatty acids, oleic acid, linoleic acid, or the like. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid, and the like; long-chain alpha, omega-dicarboxylic acids in the molecular weight range of 600 to 3000; and other similar materials. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of acidic corrosion inhibitors are the half esters of alkenyl succinic acids having 8 to 24 carbon atoms in the alkenyl group with alcohols such as the polyglycols. Especially preferred rust inhibitors for use in the present invention include the primary and secondary amine compounds taught herein as the amine portion of the salt of a phosphoric acid ester as well as mixtures of said amines with other rust inhibitors described above. When an amine salt of a phosphoric acid ester is used as the phosphorus-containing anti-wear agent of the present invention, it may not be necessary to add additional amine-containing rust inhibitors to the gear oil formulation. In a preferred embodiment, the primary and secondary amines will contribute from 40 to 125 ppm nitrogen (on a weight/weight basis) to the formulated gear oil, whether they are classified as a rust inhibitor, part of the anti-wear system or a combination of both.

Supplemental friction modifiers may also be included to provide, for example, limited slip performance, or enhanced positraction performance. These friction modifiers typically may include such compounds as molybdenum containing compounds such as molybdenum carboxylates, molybdenum amides, molybdenum thiophosphates, and molybdenum thiocarbamates, and so forth. Other suitable friction modifiers include fatty amines or ethoxylated fatty amines; aliphatic fatty acid amides; ethoxylated aliphatic ether amines; aliphatic carboxylic acids; glycerol esters; aliphatic carboxylic ester-amides and fatty imidazolines; fatty tertiary amines, wherein the aliphatic group usually contains above about eight carbon atoms so as to render the compound suitably oil soluble. Also suitable are aliphatic substituted succinimides formed by reacting one or more aliphatic succinic acids or anhydrides with ammonia or other primary amines.

The diluents that may be used include the types previously described herein, and reference is made thereto.

In one embodiment, the inventive lubricant compositions may contain, or alternatively are essentially devoid, of conventional, ashless dispersants such as carboxylic-type ashless dispersants, Mannich base dispersants and the post-treated dispersants of these types as well as dispersant viscosity index improvers and dispersant pour point depressants. The ashless dispersants that may be eliminated from the lubricant composition of this invention include the polyamine succinimides, the alkenyl succinic acid esters and diesters of alcohols containing 1-20 carbon atoms and 1-6 hydroxyl groups, alkenyl succinic ester-amide mixtures and Mannich dispersants.

The lubricant compositions of the present invention are suitable to prevent gear-tooth ridging, rippling, pitting, welding, spalling, and excessive wear or other surface distress and objectionable deposits and not produce excessive wear, pitting or corrosion of bearing rollers under high torque conditions.

According to an embodiment of the present invention, the finished lubricants may have different primary viscosity grades which are indicated by the maximum temperature for viscosity of 150,000 cP according to ASTM D 2983 as defined in SAE J306 Automotive Gear and Lubricant Viscosity Classification.

As used herein, the term "percent by weight", unless expressly stated otherwise, means the percentage the recited component represents to the weight of the entire composition.

The following examples are presented to illustrate the invention, but the invention is not to be considered as limited thereto. In the following examples, parts are by weight unless indicated otherwise.

EXAMPLES

Example 1

A series of oil formulations were prepared to examine the effect of various additives on the load carrying capacity properties of the oil formulations.

Lubricant Additive Descriptions

Various surface-active agents were added to industrial oils to investigate the effects on load carrying capacity. These additives can be placed in four broad classes; extreme pressure agents (EP), anti-wear compounds (AW), friction modifiers (FM), and dispersants (DISP). These four classes of compounds or components are identified by their conventionally-recognized functions for sake of convenience, and not limitation.

In the examples, two EP compounds were examined, which were the following: EP 1, an olefin sulfide which specifically was HiTEC®-313 from Ethyl Corporation; and EP2, an alkyl polysulfide which was obtained as TPS44 from Elf Atochem.

Three AW compounds were examined, which were the following: AW1, an alkyl dithiothiadiazole which was HiTEC®-4313 from Ethyl Corporation; AW2, an alkyl thiophosphate ester which was HiTEC®-511T from Ethyl Corporation; and AW3, a mixture of alkylphosphorothioates and hydrocarbylamines which was HiTEC®-833 from Ethyl Corporation.

Three FM compounds were examined, which were the following: FM1, a long chain alkyl phosphonate which was HiTEC®-059 from Ethyl Corporation; FM2, a dithiocarbamate which was Molyvan®-822 from R.T. Vanderbilt Company, Inc.; and FM3, a long chain alkyl alkeneamine which more particularly was obtained as Duomeen-O from Akzo Chemical Company.

A DISP compound also was included in some formulations, which was the following: DISP1, a polyolefin amide alkeneamine which was HiTEC®-633 from Ethyl Corporation.

In Example 1, EP 1 is present in the finished oil at a concentration of 1.33 weight percent. In Examples 2 through 16 the concentrations of EP, AW, and FM in each fluid are 1.5, 1.0 and 0.5 weight percent, respectively. In the examples in which the DISP was present in the finished oils, it was added at a concentration of 1.0 weight percent. In all other examples the concentration of the additives are listed in the examples. All oils listed in the examples are blended in a 85:15 wt:wt mixture of PAOs (Durasyn 168 and Durasyn 174 from BP Oil Company) and ester (Priolube-3970 from Uniqema) at the above-indicated additive levels, and the finished oils also contained 0.45 weight percent of a standard industrial anti-rust/anti-oxidant package, HiTEC®-2590A from Ethyl Corporation.

Load carrying capacity tests were conducted on the lubricant samples according to ASTM D-2782, and the results are indicated in the following tables under the heading "Timken Load." For purposes of these studies, a "good" result was a Timken load value of greater than 80. The various runs have been grouped into different tables so that relevant comments on the results for each test group can be interposed as the results are presented. The symbol "-" in the tables means "none."

TABLE 1

| Example (Oil Sample No.) | EP | AW | FM | DISP | Timken Load (lb.) |
|---|---|---|---|---|---|
| 1 | EP1 | — | — | — | 70 |
| 2 | EP1 | AW2 | FM2 | — | 55 |
| 3 | EP1 | AW2 | FM2 | DISP | 55 |
| 4 | EP1 | AW1 | FM2 | DISP | 50 |
| 5 | EP1 | AW2 | FM1 | — | 65 |
| 6 | EP1 | AW1 | FM1 | — | 60 |
| 7 | EP1 | AW1 | FM1 | DISP | 65 |
| 8 | EP1 | AW1 | FM3 | — | 70 |
| 9 | EP1 | AW2 | FM3 | DISP | 65 |

Example 1 shows the Timken load carrying capacity for a fluid that contains EP 1. This fluid had marginal load carrying capacity. Examples 2 through 9 show fluids that contained different additives to assess whether they improve the load carrying capacity of the oil. None of the combinations of additives improved the load carrying capacity of the oils, i.e., all the Timken load capacity results are the same (Example 8) or actually even less than (Examples 2-7, 9) the results for Example 1 in which only the EP additive was included. For instance, in Example 9, FM3, an alkylene amine, was mixed with AW2, an antiwear agent containing both S and P. This mixture of additives was associated with a diminished load-carrying capacity in the oil of Example 9 as compared to that of Example 1 containing only the extreme pressure agent additive.

TABLE 2

| Example (Oil Sample No.) | EP | AW | FM | DISP | Timken Load (lb.) |
|---|---|---|---|---|---|
| 10 | EP1 | AW3 | FM2 | — | 95 |
| 11 | EP1 | AW3 | FM1 | — | 110 |
| 12 | EP1 | AW3 | FM1 | DISP | 110 |
| 13 | EP1 | AW3 | FM3 | — | 95 |
| 14 | EP1 | AW3 | FM3 | DISP | 100 |
| 15 | EP2 | AW3 | FM3 | — | 100 |
| 16 | EP2 | AW3 | FM3 | DISP | 100 |

Examples 10 through 16 show that the unexpected results for fluids that contain AW3, the mixture of alkylphosphorothioates and hydrocarbylamines. All fluids of Examples 10 through 16 had a Timken load carrying capacity results greater than 90 lb. This beneficial performance of the additive mixture of AW3 was achieved in the presence of different EP agents (EP1 and EP2), different friction modifiers (FM1, FM2, and FM3), and in fluids both containing and not containing the dispersant (DISP). This result was considered as being unexpected given that, for example, the combination of FM3 and AW2 (as in Example 9) showed no benefit.

Referring to Table 3 below, the oils of Examples 17 through 21, which represent embodiments of the present invention, also were prepared and tested for load carrying capacity.

TABLE 3

| Example (Oil Sample No.) | EP | EP wt % | AW3 wt % | FM3 wt % | DISP wt % | Timken Load (lb.) |
|---|---|---|---|---|---|---|
| 17 | EP1 | 1.5 | 1.00 | 0.50 | 1.5 | 105 |
| 18 | EP2 | 1.5 | 1.00 | 0.50 | 2.5 | 105 |
| 19 | EP1 | 1.0 | 0.75 | 0.35 | 1.5 | 95 |
| 20 | EP2 | 1.0 | 0.60 | 0.25 | 2.0 | 100 |
| 21 | EP2 | 1.0 | 0.30 | 0.25 | 1.0 | 80 |

Referring to the results given in Table 3, Examples 17 through 21 show fluids formulated with different concentrations of AW3, FM3, DISP, and EP compound (EP1 or EP2). As seen from the results, AW3 imparts good load carrying capacity to a fluid at concentrations as low as 0.30 weight percent. The mixture of AW3 also was seen to be effective when the concentrations and types of EP were varied, and when the concentrations of the friction modifier, FM3, and dispersant, DISP, were varied.

INDUSTRIAL APPLICABILITY

Among other geared device applications, the wind turbine industry needs improved lubricating formulations for use in gear-boxes. This invention provides an improved gear oil with superior load carrying capacity, which is well-suited for the demands of that and other geared device applications. Other geared applications for the lubricant compositions of this invention include automotive oils, such as vehicular differential oils.

The disclosures of each patent or publication cited in the foregoing disclosure are incorporated herein by reference as if fully set forth herein.

While the preferred embodiments have been fully described and depicted for the purposes of explaining the principles of the present invention, it will be appreciated by those skilled in the art that modifications and changes may be made thereto without departing from the scope of the invention set forth in the appended claims.

What is claimed:

1. A wind turbine gear additive concentrate, comprising:

a) about 20 to about 60 wt. % of an extreme pressure compound comprising a sulfur-containing compound;

b) load carrying capacity enhancing combination comprising (i) about 10 to about 30 wt. % of a hydrocarbylamine compound selected from the group consisting of N-oleyl-trimethylene diamine, N-tallow-trimethylene diamine, N-coco-trimethylene diamine, and combinations thereof, and (ii) about 10 to about 30 wt. % of an alkylphosphoro (mono)thioate compound represented by the formula:

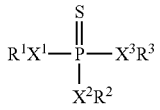

where each of $R^1$, $R^2$, and $R^3$ is, independently, an unsubstituted alkyl group or a hydrogen atom, and where at least one of $R^1$, $R^2$, and $R^3$ is an unsubstituted alkyl group, and where each of $X^1$, $X^2$, and $X^3$ represents an oxygen atom;

c) about 10 to about 30 wt. % of a long chain alkyl phosphonate friction modifying compound represented by the formula:

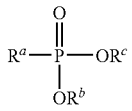

wherein $R^a$ is an alkyl group having from 12 to 18 carbon atoms and $R^b$ and $R^c$ each independently comprise from about 1 to about 4 carbon atoms; and d) a diluent oil, wherein any of compounds a), b)(i), b)(ii), and c) can be the same or different compounds.

2. The additive concentrate according to claim 1, wherein at least one of $R^1$, $R^2$, and $R^3$ is an unsubstituted aliphatic alkyl group of 3 to 20 carbon atoms.

3. The additive concentrate according to claim 1, wherein the extreme-pressure agent comprises a metal-free sulfur-containing extreme-pressure agent selected from the group consisting of sulfurized olefin and polysulfide composed of one or more groups represented by the formula $R_a$—$S_x$—$R_b$ where $R_a$ and $R_b$ are hydrocarbyl groups each of which contains 3 to 18 carbon atoms and x is in the range of from 2 to 8.

4. A wind turbine gear composition, comprising:

a) about 0.5 to about 2.5 wt. % of an extreme pressure compound comprising a sulfur-containing compound;

b) load carrying capacity enhancing combination comprising (i) about 0.1 to about 1.0 wt. % of a hydrocarbylamine compound selected from the group consisting of N-oleyl-trimethylene diamine, N-tallow-trimethylene diamine, N-coco-trimethylene diamine, and combinations thereof, and (ii) about 0.1 to about 1.0 wt. % of an alkylphosphoro (mono)thioate compound represented by the formula:

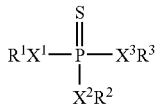

where each of $R^1$, $R^2$, and $R^3$ is, independently, an unsubstituted alkyl group or a hydrogen atom, and where at least one of $R^1$, $R^2$, and $R^3$ is an unsubstituted alkyl group, and where each of $X^1$, $X^2$, and $X^3$ represents an oxygen atom;

c) about 0.1 to about 1.0 wt. % friction modifying compound of a long chain alkyl phosphonate friction modifying compound represented by the formula:

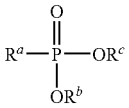

wherein $R^a$ is an alkyl group having from 12 to 18 carbon atoms and $R^b$ and $R^c$ each independently comprise from about 1 to about 4 carbon atoms; and d) about 90 to about 99 wt. % of base oil, wherein any of compounds a), b)(i), b)(ii), and c) can be the same or different compounds with the proviso that b)(i) and b)(ii) are different.

5. The composition according to claim 4, wherein at least one of $R^1$, $R^2$, and $R^3$ is an unsubstituted aliphatic alkyl group of 3 to 20 carbon atoms.

6. The composition according to claim 4, wherein the extreme-pressure agent comprises a metal-free sulfur-containing extreme-pressure agent selected from the group consisting of sulfurized olefin and polysulfide composed of one or more groups represented by the formula $R_a$—$S_x$—$R_b$ where $R_a$ and $R_b$ are hydrocarbyl groups each of which contains 3 to 18 carbon atoms and x is in the range of from 2 to 8.

7. The composition according to claim 4, wherein the composition has a kinematic viscosity of at least 12 cSt at 100° C.

8. The composition according to claim 4, wherein the base oil has a viscosity in the range of SAE 50 to SAE 250.

9. The composition according to claim 4, wherein the base oil has a viscosity in the range of SAE 70W to SAE 140.

10. A method of manufacturing a composition suitable for use in a wind turbine gear assembly comprising blending a base oil; about 0.5 to about 2.5 wt. % of an extreme pressure compound comprising a sulfur-containing compound; about 0.1 to about 1.0 wt. % of a hydrocarbylamine compound selected from the group consisting of N-oleyl-trimethylene diamine, N-tallow-trimethylene diamine, N-coco-trimethylene diamine, and combinations thereof; about 0.1 to about 1.0 wt. % of an alkylphosphoro(mono)thioate compound represented by the formula:

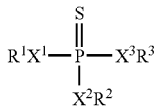

where each of $R^1$, $R^2$, and $R^3$ is, independently, an unsubstituted alkyl group or a hydrogen atom, and where at least one of $R^1$, $R^2$, and $R^3$ is an unsubstituted alkyl group, and where each of $X^1$, $X^2$, and $X^3$ represents an oxygen atom; and about 0.1 to about 1.0 wt. % friction modifying compound of a long chain alkyl phosphonate friction modifying compound represented by the formula:

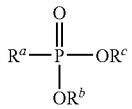

wherein $R^a$ is an alkyl group having from 12 to 18 carbon atoms and $R^b$ and $R^c$ each independently comprise from about 1 to about 4 carbon atoms, and wherein the composition demonstrates improved load carrying capacity as compared to a composition devoid of the hydrocarbylamine compound and alkylphosphoro(mono)thioate compound.

11. A method of lubricating a gear comprising using as the lubricant for said gear a gear oil composition according to claim 4.

12. A lubed gear-box comprising a gear within the gear box, in which the gear is lubricated according to the method of claim 11.

13. A method of lubricating a wind turbine gear assembly comprising using as the lubricant for said gear assembly a composition according to claim 4.

14. A wind turbine gear assembly lubricated with a composition according to claim 4.

* * * * *